US010829337B2

(12) United States Patent
DeCooman

(10) Patent No.: US 10,829,337 B2
(45) Date of Patent: Nov. 10, 2020

(54) YARN HOLDER, KNITTING STATION, AND KIT

(71) Applicant: Jocelyn B DeCooman, Apex, NC (US)

(72) Inventor: Jocelyn B DeCooman, Apex, NC (US)

( * ) Notice: Subject to any disclaimer, the term of this patent is extended or adjusted under 35 U.S.C. 154(b) by 122 days.

(21) Appl. No.: 16/288,974

(22) Filed: Feb. 28, 2019

(65) Prior Publication Data

US 2019/0263624 A1 Aug. 29, 2019

Related U.S. Application Data

(60) Provisional application No. 62/636,356, filed on Feb. 28, 2018.

(51) Int. Cl.

| | |
|---|---|
| ***B65H 49/26*** | (2006.01) |
| ***B65H 49/36*** | (2006.01) |
| ***B65H 99/00*** | (2006.01) |
| ***D04B 3/06*** | (2006.01) |
| ***B65H 49/32*** | (2006.01) |
| *D04B 3/02* | (2006.01) |

(52) U.S. Cl.

CPC ..... *B65H 49/26* (2013.01); *B65H 49/327* (2013.01); *B65H 49/36* (2013.01); *B65H 99/00* (2013.01); *D04B 3/06* (2013.01); *B65H 2701/31* (2013.01); *D04B 3/02* (2013.01)

(58) Field of Classification Search

CPC ..... B65H 49/00; B65H 49/26; B65H 49/36; B65H 49/327; B65H 49/20; B65H 49/205; B65H 49/28; B65H 49/30; B65H 49/305; B65H 49/32; B65H 49/322–325; B65H 49/34; B65H 99/00; B65H 2701/31; D04B 3/00; D04B 3/02; D04B 3/06; D04B 33/00; D05B 91/06; D05B 91/12; D05B 91/14; D05B 91/16; A47G 19/08; A47B 96/025; A47B 96/02

USPC ..... D7/501, 505, 533.6, 554.2; D6/707.11; D28/73; D3/20, 21, 23, 24

See application file for complete search history.

(56) References Cited

U.S. PATENT DOCUMENTS

| | | | | | |
|---|---|---|---|---|---|
| 951,664 | A | * | 3/1910 | Swan | |
| 996,875 | A | * | 7/1911 | Morrison | |
| 1,401,474 | A | * | 12/1921 | Jackson | A47F 13/04 242/141 |
| 2,240,675 | A | * | 5/1941 | Selinger | B65H 49/26 225/19 |
| 2,246,713 | A | | 6/1941 | Benson | |
| 2,254,468 | A | | 9/1941 | Benson | |
| 2,410,018 | A | * | 10/1946 | D Arcy | D04B 3/06 242/141 |
| 2,419,415 | A | * | 4/1947 | Morf | B65H 75/105 242/118.31 |
| 2,448,457 | A | * | 8/1948 | Olson | B65H 49/06 242/118.32 |
| 2,491,585 | A | | 12/1949 | Sammons | |
| 2,536,931 | A | * | 1/1951 | Harward | B65H 49/26 242/141 |
| 3,420,468 | A | | 5/1967 | Rhoades | |
| 3,764,086 | A | | 10/1973 | Garzonio | |

(Continued)

*Primary Examiner* — Ismael Izaguirre

(74) *Attorney, Agent, or Firm* — Olive & Olive, P.A.

(57) ABSTRACT

A yarn holder, knitting station, and kit include a base with suction cups to be secured on a surface. A yarn support spinning plate is mounted on the base in spinning relation to the base. A yarn rod is connected to the plate for holding yarn around the rod.

14 Claims, 12 Drawing Sheets

(56) References Cited

U.S. PATENT DOCUMENTS

| | | | | | |
|---|---|---|---|---|---|
| 3,972,419 | A * | 8/1976 | Short | A47G 23/08 | 211/78 |
| 3,987,979 | A | 10/1976 | Knispel | | |
| 4,112,711 | A | 9/1978 | Tripp | | |
| 4,955,557 | A | 9/1990 | Sewell et al. | | |
| 5,209,423 | A * | 5/1993 | Barginear | A01K 89/003 | 242/129.8 |
| 5,297,671 | A * | 3/1994 | Ruth | B65H 49/06 | 198/465.1 |
| 5,842,655 | A * | 12/1998 | McCarthy | B65H 49/28 | 242/129 |
| 6,702,226 | B1 * | 3/2004 | Bowling | A01K 89/003 | 242/125.2 |
| 2013/0015282 | A1 * | 1/2013 | Thole | D04B 3/06 | 242/127 |

* cited by examiner

YARN HOLDER, KNITTING STATION, AND KIT

CROSS-REFERENCE TO RELATED APPLICATIONS

This application is related to and claims priority to provisional application Ser. No. 62/636,356, entitled Yarn Knitting Station, filed Feb. 28, 2018, the disclosure of which is specifically incorporated by reference herein in its entirety.

FIELD OF INVENTION

The invention relates to a yarn holder, knitting station, and kit which rotatably supports a ball of yarn, mounted around a rod to provide an improved automatic feed for unwinding the yarn as it is used for knitting.

BACKGROUND

Numerous approaches have been tried in the past to support yarn during knitting in a manner which makes it easy to feed the yarn with a simple arrangement without having the yarn fall and/or unravel.

Such prior attempts have generally involved the construction of complex mechanisms to feed the yarn. However, none allow for easy feed of yarn in a controlled and stable manner, and which further provides means for temporarily holding already partially knitted items and knitting needles during a pause in knitting.

These problems are addressed and overcome in accordance with the invention as will be further evident from the following discussion.

SUMMARY

In accordance with the invention, a yarn knitting station and yarn holder is provided which allows easy feed of yarn and accommodates different size rolls of yarn for use during knitting.

A yarn holder, knitting station, and kit includes a base having suction cups positioned to be secured to a solid surface. A first yarn support spinning plate is provided for being supported on and spinning on the base. A yarn rod is connected to the yarn support spinning plate for holding yarn around the rod to allow the yarn to be unwound therefrom and the spinning plate to turn as the yarn is unwound.

In one embodiment the yarn rod has a hollow interior and open top for holding items used for knitting therein The base and plate are connected together through an O-ring and bearing arrangement to allow free movement of the spinning plate relative to the base. The O-ring serves as a support base for the bearing allowing the spinning plate to turn much more easily as a result of separating the spinning plate from the base.

BRIEF DESCRIPTION OF THE DRAWINGS

Having thus briefly described the invention, the same will become better understood from the following detailed description made with reference to the appended drawings wherein.

DETAILED DESCRIPTION OF EXEMPLARY EMBODIMENTS

Figure 1:
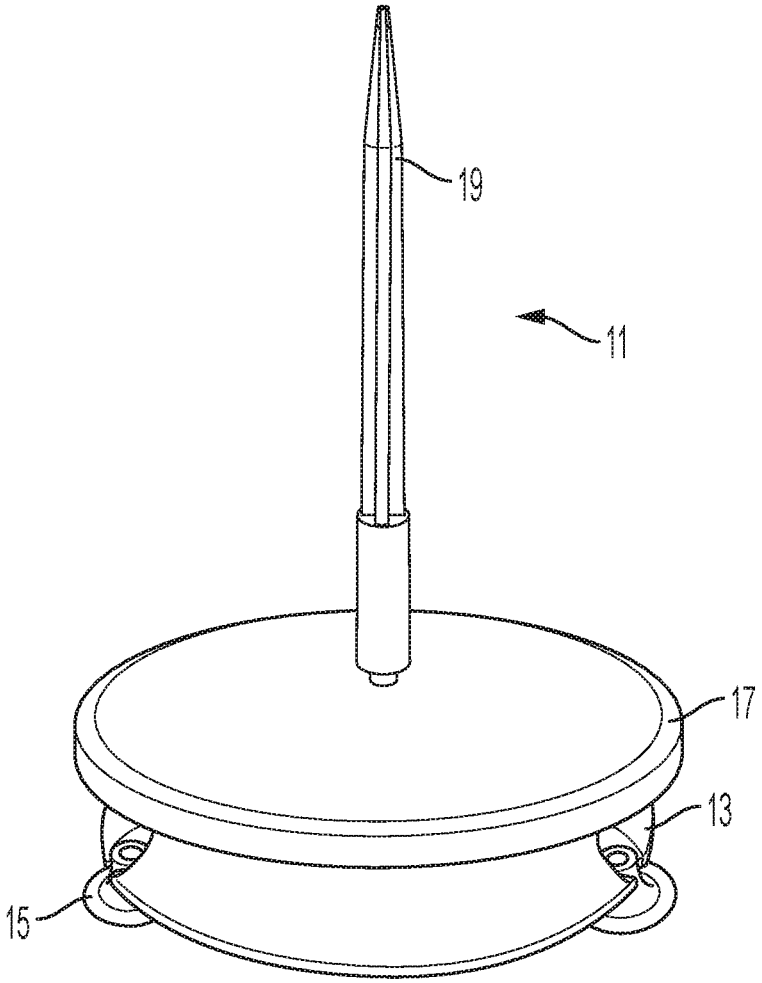
FIG. 1 is a perspective view of the yarn holder of the invention including a rod around which is wound a roll of yarn.

FIG. 1 illustrates an embodiment of the yarn knitting station 11 in accordance with the invention. A knitting station base 13 includes suction cups 15 to be secured to a solid surface through the suction cups 15. The knitting station base 13 supports a yarn support spinning plate 17 in rotational relationship with respect to the base 13. A yarn rod 19 is connected to and extends upwardly from the yarn support spinning plate 17 to allow yarn to be wrapped around the yarn rod 19, and unwound by pulling on the yarn, causing the yarn support spinning plate 17 to turn.

Figure 2:
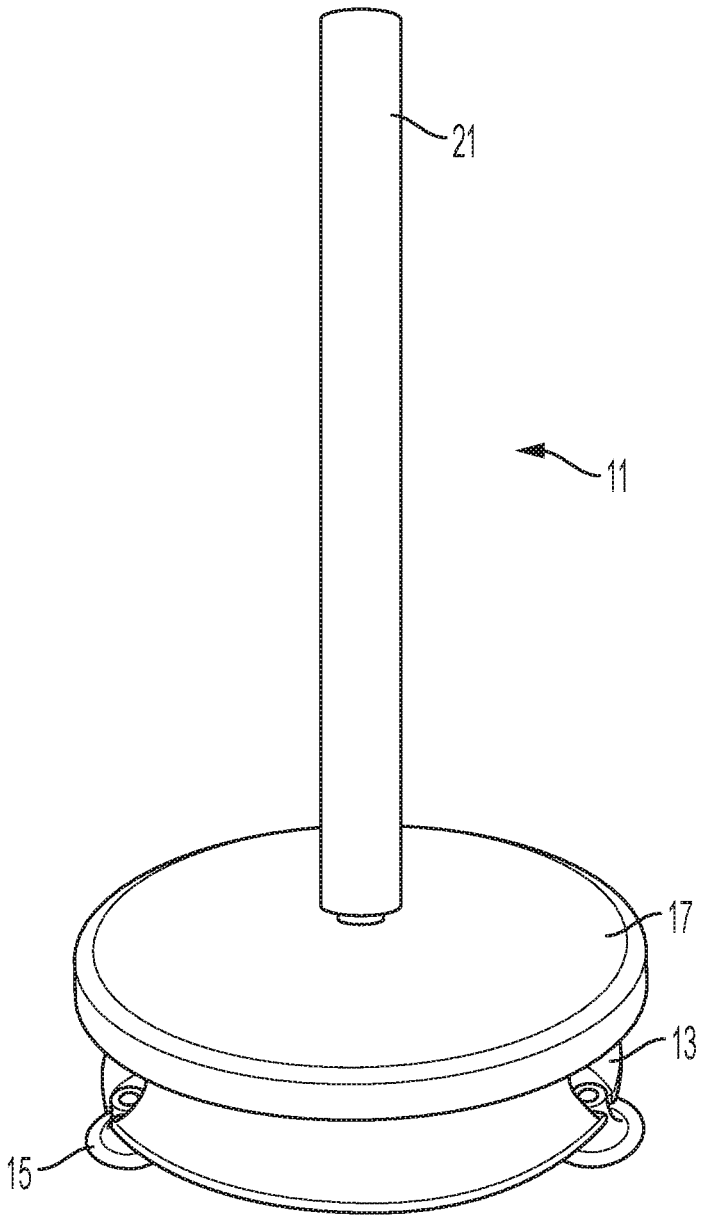
FIG. 2 is a perspective view of an alternative embodiment of the yarn holder of the invention, including the rod in the shape of a hollow tube, replacing the rod of FIG. 1, around which yarn is held, and wherein the hollow interior is used for holding, for example, knitting needles.

FIG. 2 is an alternative embodiment of the invention, in this case showing a hollow yarn rod 21. The yarn rod 21 can house an assortment of things within it such as knitting needles while the knitting station 11 is not in use, without having to remove the knitting needles and partially completed knitting work product.

Figure 3:
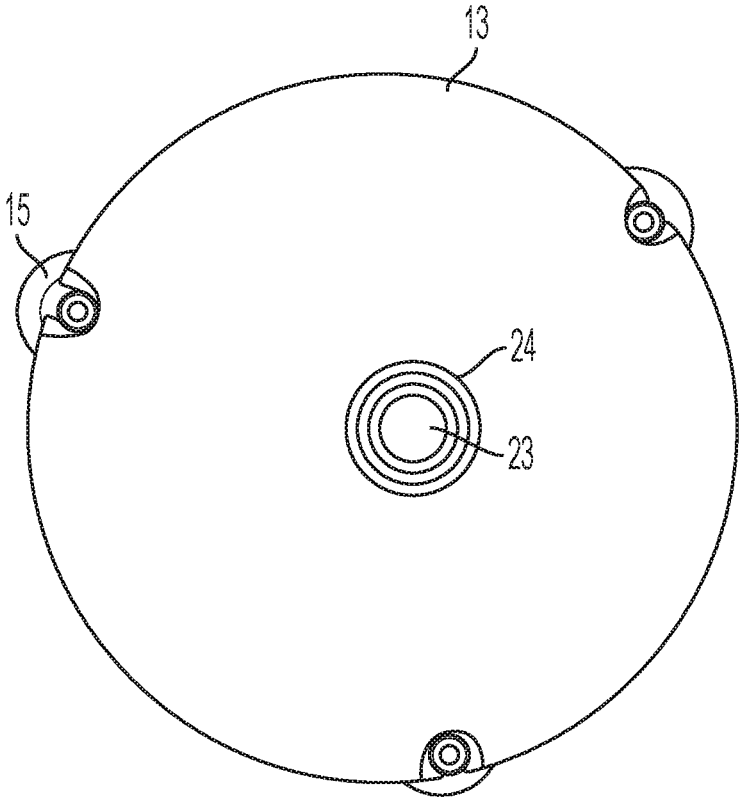
FIG. 3 is a top plan view of a base for the yarn holder of the invention shown with a tubular extension, having an "O" ring seated around the tubular extension, having an O-ring seated around the tubular extension, and serving as a support and spacer for the bearing.
Figure 4:
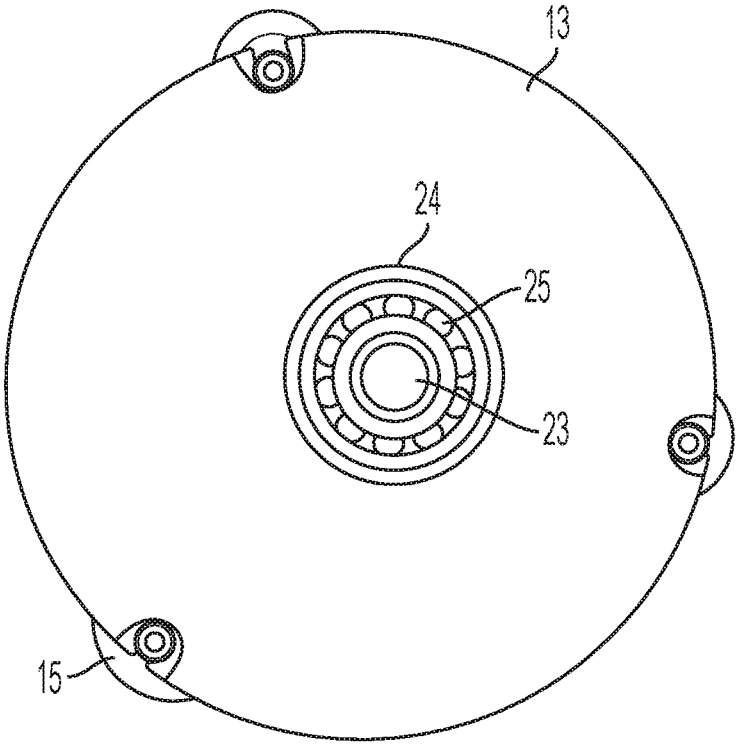
FIG. 4 is a top plan view of the base of the yarn holder of the invention shown with an O-ring and bearing mounted thereon.
Figure 5:
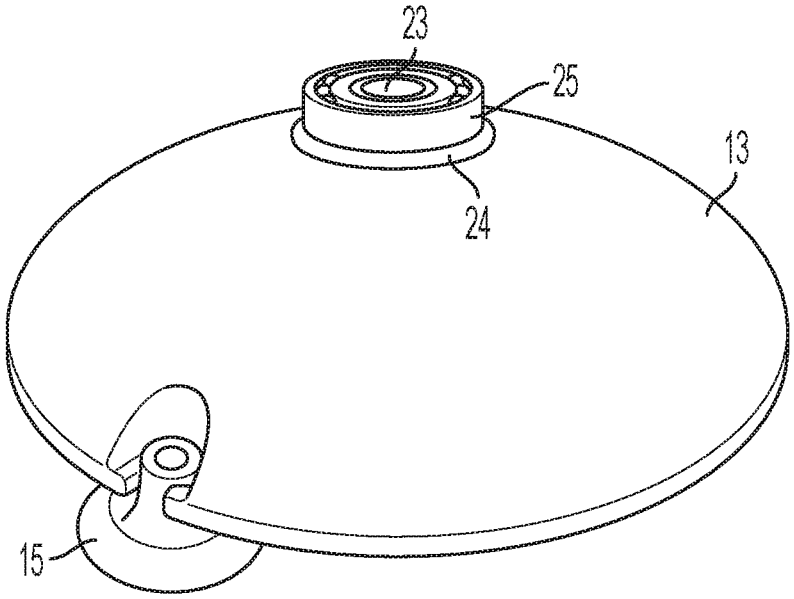
FIG. 5 is a perspective view of the base of the yarn holder of the invention shown in FIG. 4, with the bearing mounted thereon.

FIG. 3 is a top perspective view illustrating a knitting station base 13 in accordance with the invention, showing a raised tubular extension 23 with an "O" ring mounted around the extension 23. This "O" ring is very important to the operation. More specifically, it serves as a base and support for a bearing 25, providing spacing between the bearing 25 and the top of the base 13 allowing the yarn support and spinning plates 17 to turn more easily. As the yarn knitting station 11 is assembled as shown in FIG. 4, the bearing 25 is placed onto the raised tubular extension 23, and held thereon. This is illustrated more clearly in FIG. 5, which is a perspective view of the knitting station base 13.

Figure 6:
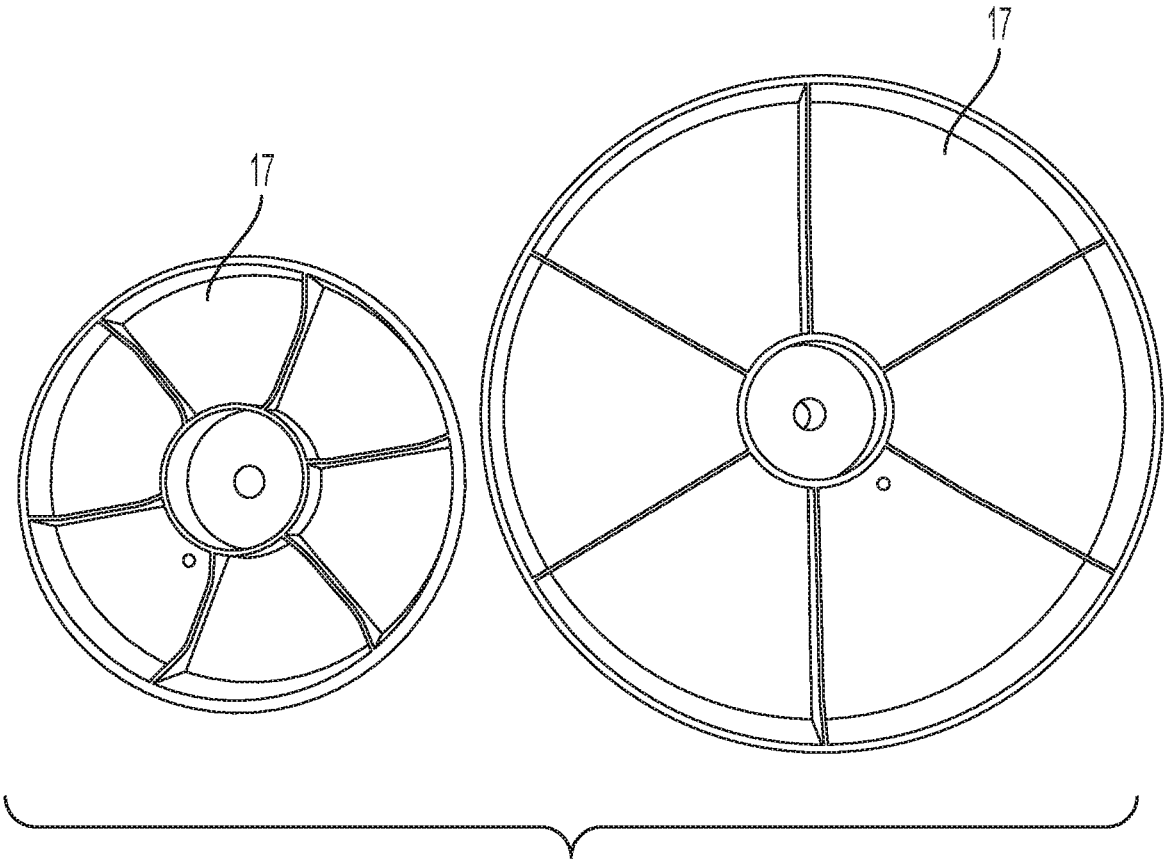
FIG. 6 is a bottom plan view of two rotatable yarn support spinning plates shown in two sizes for the yarn holder of the invention.
Figure 7:
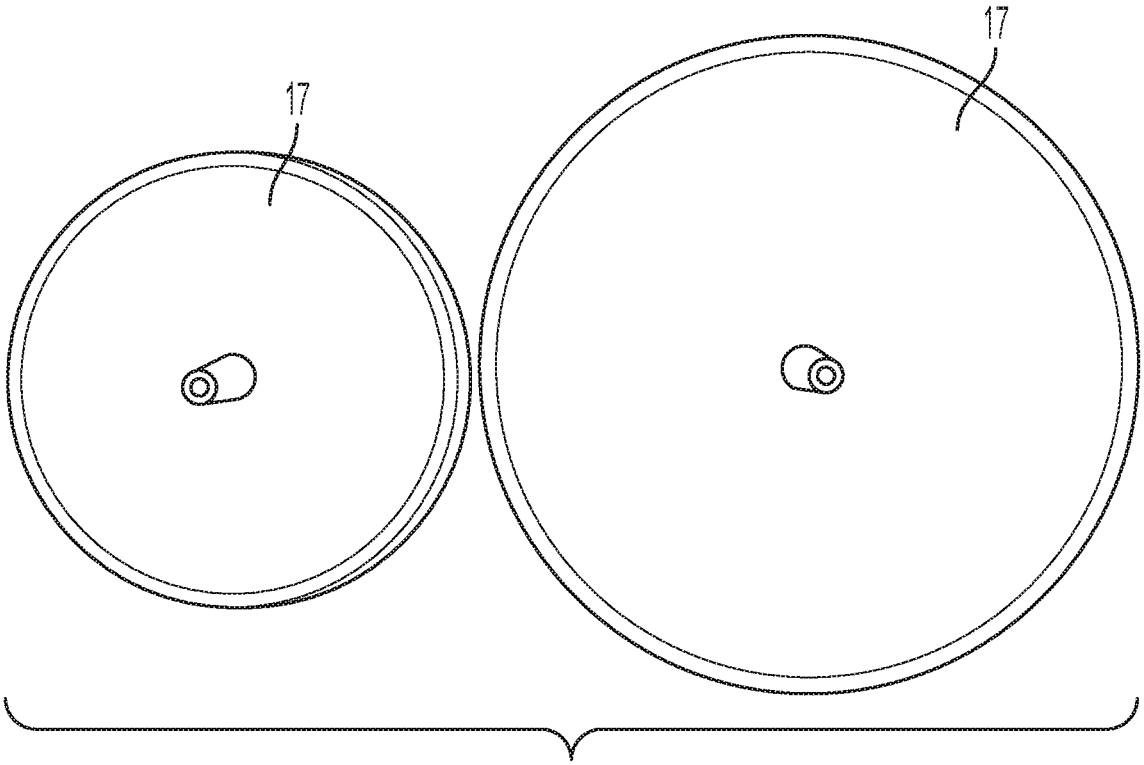
FIG. 7 is a top plan view of the base of the rotatable yarn support plate shown in FIG. 6.
Figure 8:
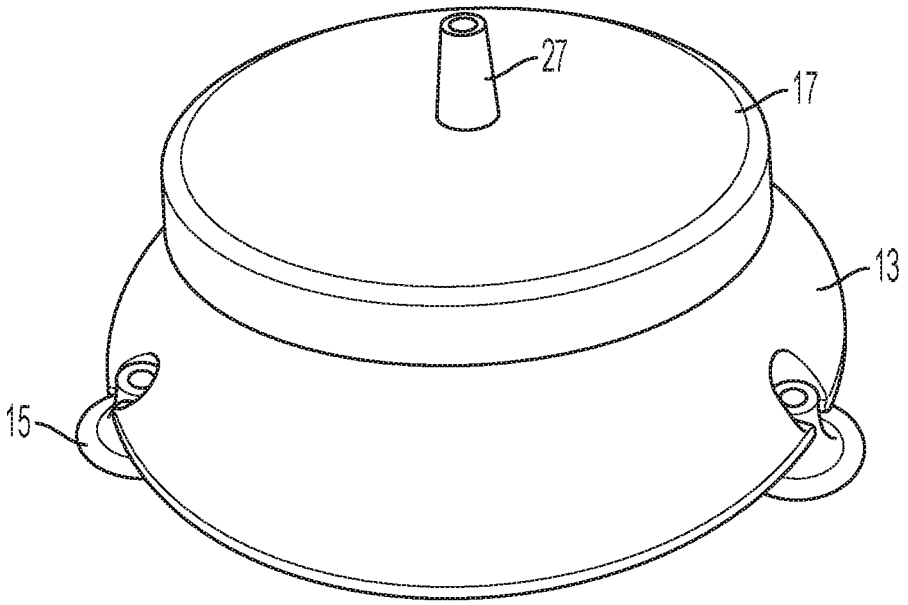
FIG. 8 is a perspective view of the base of the yarn holder of the invention shown with a yarn support plate mounted thereon.

FIGS. 6 and 7 illustrate the bottom and top views of yarn support spinning plates 17, which come preferably in two sizes, one large and one small relative to each other, depending on the amount of yarn to be supported. FIG. 8 is an alternative view of the yarn knitting station 11 partially assembled with a post 27 extending from spinning plate 17 on which a yarn rod 19 can be supported.

Figure 9:
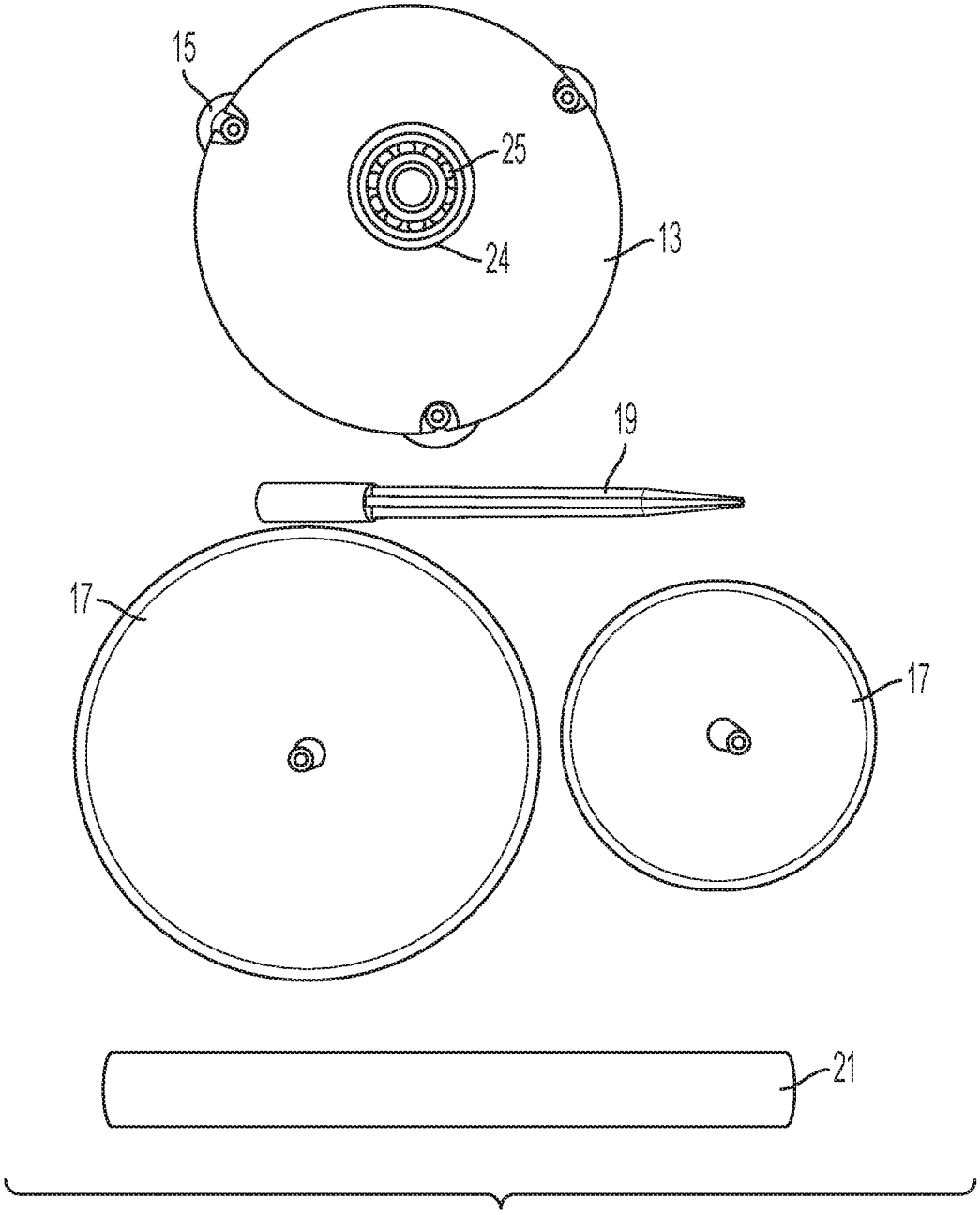
FIG. 9 is a disassembled view showing various components of the invention.

FIG. 9 shows the various components of the yarn knitting station 11 of the invention in disassembled form.

Figure 10:
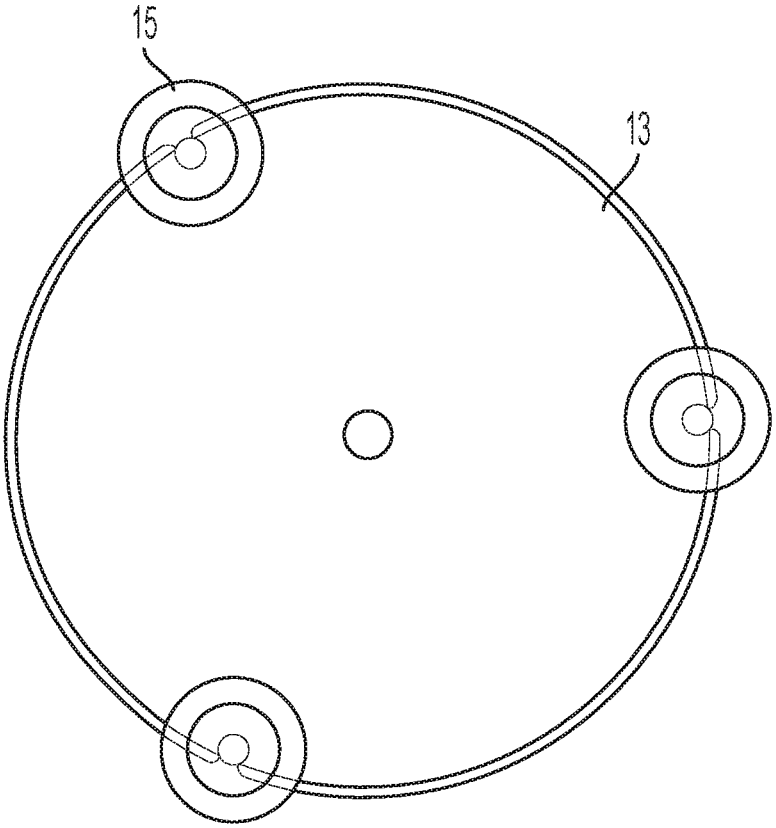
FIG. 10 is a bottom plan view of the base of the yarn holder of the invention.

FIG. 10 shows the bottom of the knitting station base 13 showing the suction cups 15 mounted thereon.

Figure 11:
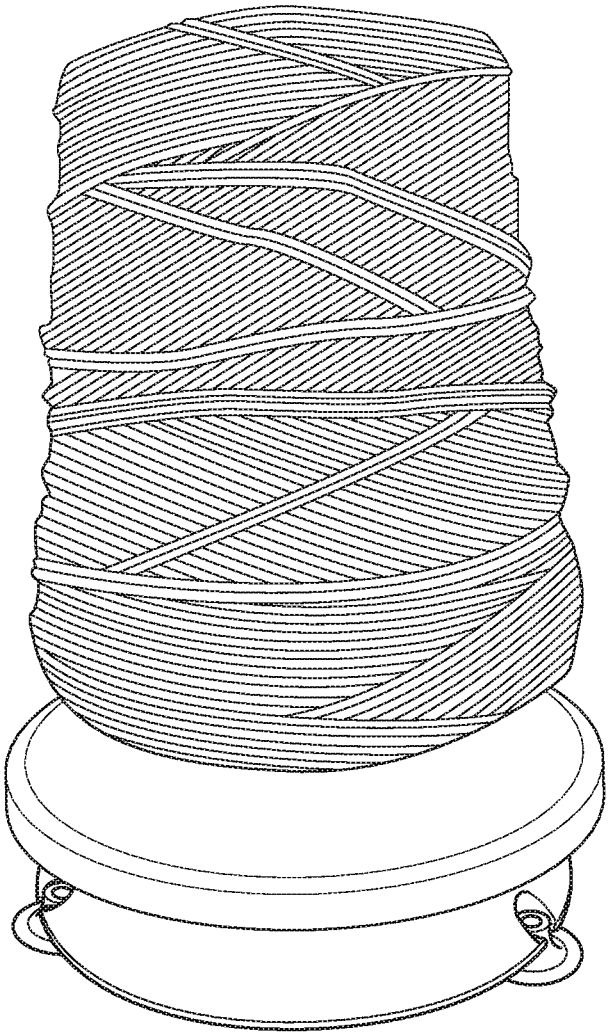
FIG. 11 is perspective view of the yarn knitting station and yarn holder of the invention shown with a smaller yarn support plate with yarn supported thereon.

FIG. 11 shows the yarn knitting station 11 of the invention shown with yarn mounted thereon.

Figure 12:
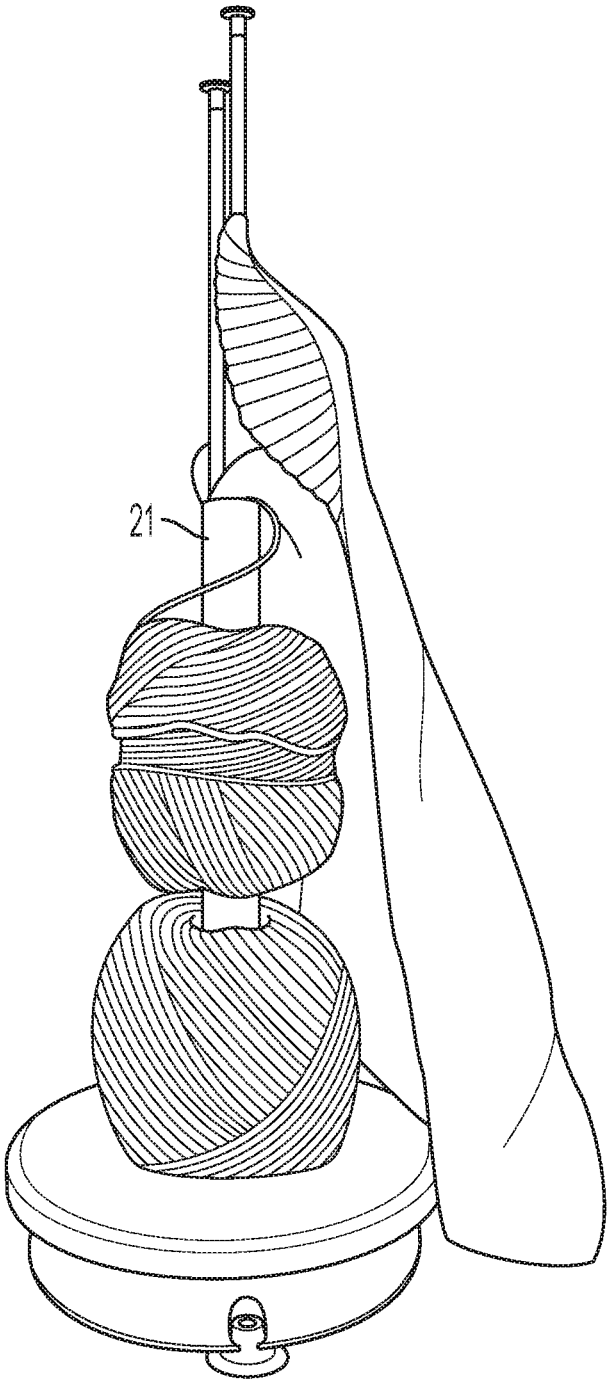
FIG. 12 is a perspective view of the yarn holder of the invention shown with a yarn support plate with yarn supported around a hollow tubular yarn spike with the knitting needles supported within the hollow yarn spike.

FIG. 12 shows an embodiment of the yarn knitting station 11 with the hollow yarn rod 21 mounted thereon and with a partially knitted article attached to knitting needles which in turn are mounted within the hollow interior of the tubular yarn rod 21.

To further understand the invention attached hereto, with the disclosure thereof incorporated by reference herein in its entirety, is an Appendix comprised of mechanical drawings of the various components making up the invention previously described.

Having thus specifically described the invention, it will be understood to those of ordinary skill that various alternative embodiments can be implemented in place of the specific components described herein without departing from the spirit and scope of the invention.

The invention claimed is:

1. A yarn holder, knitting station, and kit, comprising:

a) a base having suction cups positioned to be secured to a solid surface, said base comprising a raised cylindrical portion extending up from the center of the base;

b) an O-ring mounted around the cylindrical portion and supported on a top of the base;

c) a bearing mounted around the raised cylindrical portion and supported on the O-ring; a first yarn support spinning plate supported in spinning relation on the base on said bearing; and d) a yarn rod connected to the yarn support spinning plate for holding yarn around the rod to allow the yarn to be unwound therefrom and the spinning plate to turn as the yarn is pulled.

2. The yarn holder, knitting station, and kit of claim 1, wherein said yarn rod has a hollow interior and open top for holding items used for knitting therein.

3. The yarn holder, knitting station, and kit of claim 1, wherein the base comprises the raised cylindrical portion at an upper surface thereof at the center of the base; said O-ring and said bearing are mounted on and around the cylindrical portion, and the spinning plate includes a recess at the bottom thereof in its center for receiving the bearing therein for allowing the plate to spin relative to the base.

4. The yarn holder, knitting station, and kit of claim 1, further comprising a second yarn support spinning plate of a different size than the first yarn support spinning plate.

5. The yarn holder, knitting station, and kit of claim 1, wherein said first yarn support spinning plate further comprises a raised portion at the center thereof on the top surface for receiving the yarn rod thereon at a hollow bottom section of the yarn rod.

6. The yarn holder, knitting station, and kit of claim 2, wherein said first yarn support spinning plate further comprises a raised portion at the center thereof on the top surface for receiving the yarn rod thereon at a hollow bottom section of the yarn rod.

7. The yarn holder, knitting station, and kit of claim 4, wherein said first yarn support spinning plate further comprises a raised portion at the center thereof on the top surface for receiving the yarn rod thereon at a hollow bottom section of the yarn rod.

8. A yarn holder and knitting station, comprising:

a) a base having suction cups positioned to be secured to a solid surface, said base comprising a raised cylindrical portion extending up from the center of the base;

b) an O-ring mounted around the cylindrical portion and supported on a top of the base c) a bearing mounted around the raised cylindrical portion and supported on the O-ring d) a first yarn support spinning plate supported in spinning relation on the base on said bearing; and e) a yard rod connected to the yarn support spinning plate for holding yarn around the rod to allow the yarn to be unwound therefrom and the spinning plate to turn as the yarn is unwound.

9. The yarn holder and knitting station of claim 8, wherein said yarn rod has a hollow interior and open top for holding items used for knitting therein.

10. The yarn holder and knitting station of claim 8, wherein the base comprises the raised cylindrical portion at an upper surface thereof at the center of the base; said O-ring and said bearing are mounted on and around the cylindrical portion; and the spinning plate includes a recess at the bottom thereof in its center for receiving the bearing therein for allowing the plate to spin relative to the base.

11. The yarn holder and knitting station of claim 8, further comprising a second yarn support spinning plate of a different size than the first yarn support spinning plate.

12. The yarn holder and knitting station of claim 8, wherein said first yarn support spinning plate further comprises a raised portion at the center thereof on the top surface for receiving the yarn rod thereon at a hollow bottom section of the yarn rod.

13. The yarn holder and knitting station of claim 11, wherein said first yarn support spinning plate further comprises a raised portion at the center thereof on the top surface for receiving the yarn rod thereon at a hollow bottom section of the yarn rod.

14. The yarn holder and knitting station of claim 11, wherein said first yarn support spinning plate further comprises a raised portion at the center thereof on the top surface for receiving the yarn rod thereon at a hollow bottom section of the yarn rod.

* * * * *